US009967678B2

(12) United States Patent
Akino

(10) Patent No.: US 9,967,678 B2
(45) Date of Patent: May 8, 2018

(54) UNIDIRECTIONAL CONDENSER MICROPHONE UNIT, UNIDIRECTIONAL CONDENSER MICROPHONE, AND METHOD OF MANUFACTURING UNIDIRECTIONAL CONDENSER MICROPHONE UNIT

(71) Applicant: Hiroshi Akino, Kanagawa (JP)

(72) Inventor: Hiroshi Akino, Kanagawa (JP)

(73) Assignee: KABUSHIKI KAISHA AUDIO-TECHNICA, Tokyo (JP)

( * ) Notice: Subject to any disclaimer, the term of this patent is extended or adjusted under 35 U.S.C. 154(b) by 0 days. days.

(21) Appl. No.: 15/254,374

(22) Filed: Sep. 1, 2016

(65) Prior Publication Data

US 2017/0078787 A1 Mar. 16, 2017

(30) Foreign Application Priority Data

Sep. 16, 2015 (JP) ..... 2015-183297
Aug. 30, 2016 (JP) ..... 2016-167717

(51) Int. Cl.

| | |
|---|---|
| ***H04R 19/04*** | (2006.01) |
| ***H04R 19/01*** | (2006.01) |
| ***H04R 1/38*** | (2006.01) |
| ***H04R 31/00*** | (2006.01) |

(52) U.S. Cl.

CPC ..... *H04R 19/04* (2013.01); *H04R 1/38* (2013.01); *H04R 19/016* (2013.01); *H04R 31/00* (2013.01)

(58) Field of Classification Search

CPC ..... H04R 19/04; H04R 19/016; H04R 1/38; H04R 31/00

See application file for complete search history.

(56) References Cited

FOREIGN PATENT DOCUMENTS

JP 5484882 B2 5/2014

*Primary Examiner* — Matthew Eason

(74) *Attorney, Agent, or Firm* — Whitham, Curtis & Cook, P.C.

(57) ABSTRACT

A unidirectional condenser microphone unit is provided that have directionality unaffected by the external environment, and a method of manufacturing the unidirectional condenser microphone. The unidirectional condenser microphone unit having an interior and an exterior, the unidirectional condenser microphone includes a diaphragm, a fixed electrode facing the diaphragm, the fixed electrode constituting a capacitor with the diaphragm, an insulating base disposed in a back face side of the fixed electrode, the insulating base supporting the fixed electrode, an air chamber disposed in the back face side of the fixed electrode, and a gap disposed between the fixed electrode and the insulating base. The fixed electrode includes at least one sound hole in communication with the air chamber. The insulating base includes a communication hole establishing communication between the gap and the exterior of the microphone unit. The air chamber and the gap are in communication with each other.

18 Claims, 9 Drawing Sheets

UNIDIRECTIONAL CONDENSER MICROPHONE UNIT, UNIDIRECTIONAL CONDENSER MICROPHONE, AND METHOD OF MANUFACTURING UNIDIRECTIONAL CONDENSER MICROPHONE UNIT

TECHNICAL FIELD

The present invention relates to a unidirectional condenser microphone unit, a unidirectional condenser microphone, and a method of manufacturing the unidirectional condenser microphone unit.

BACKGROUND ART

A condenser microphone includes a diaphragm configured to vibrate in response to acoustic waves from a sound source and a fixed electrode constituting a capacitor with the diaphragm. The capacitance of the capacitor varies in response to the vibration of the diaphragm. The condenser microphone generates electrical signals corresponding to the variation in the capacitance of the capacitor. The generated electrical signals are output to, for example, a speaker connected to the condenser microphone.

Condenser microphones can be set to have various directionalities. One of the directionalities is unidirectionality. A unidirectional condenser microphone is used for sound collection in a specific direction (for example, the front direction).

The unidirectional condenser microphone includes a unidirectional condenser microphone unit. The unidirectional condenser microphone unit includes an acoustic resistor for achieving unidirectionality, in addition to the diaphragm and the fixed electrode.

FIG. 7 is a cross-sectional front view illustrating a conventional unidirectional condenser microphone unit. A unidirectional condenser microphone unit (hereinafter referred to as "unit") 101 includes a unit case 110, a diaphragm 120, a diaphragm holder 130, a fixed electrode 140, an insulating base 150, an air chamber 160, an acoustic resistor 170, and a metal mesh 180.

The unit case 110 accommodates the diaphragm 120, the diaphragm holder 130, the fixed electrode 140, the insulating base 150, the acoustic resistor 170, and the metal mesh 180. The unit case 110 has shape of a hollow cylinder with a bottom end. The unit case 110 is a press-molded product composed of metal, such as aluminum. The unit case 110 includes multiple acoustic-wave entering holes 110*h* introducing acoustic waves from a sound source into the unit 101. The multiple acoustic-wave entering holes 110*h* are disposed in a bottom face side (the upper side of FIG. 7) of the unit case 110. In the description below, the bottom face side (the upper side of FIG. 7) of the unit 101 having a shape of a hollow cylinder with a bottom end is referred to as the "front" of the unit 101, and an open end side (the lower side of FIG. 7) of the unit 101 is referred to as the "rear" of the unit 101.

The diaphragm 120 is a thin film having a circular shape in plan view. The diaphragm 120 is composed of synthetic resin, for example. The diaphragm 120 is stretched on the diaphragm holder 130 at predetermined tension. The diaphragm holder 130 has a shape of a ring in plan view.

FIG. 8 is a plan view illustrating the fixed electrode 140 of the conventional unit 101. The fixed electrode 140 has a shape of a disc in plan view. The fixed electrode 140 is composed of metal. The fixed electrode 140 has multiple sound holes 140*h*. The multiple sound holes 140*h* are disposed over the entire face of the fixed electrode 140.

Referring now back to FIG. 7, the fixed electrode 140 faces the diaphragm 120 with a spacer (not shown) disposed therebetween, and constitutes a capacitor with the diaphragm 120. An air layer having a thickness equivalent to the thickness of the spacer is formed between the diaphragm 120 and the fixed electrode 140.

FIG. 9 is a plan view illustrating the insulating base 150 of the conventional unit 101. The insulating base 150 has a shape of a disc in plan view. The insulating base 150 is composed of synthetic resin, for example. The insulating base 150 has a communication hole 150*h*, a depression 151, and a support 152. Acoustic waves from the sound source pass through the communication hole 150*h*. The depression 151 faces the fixed electrode 140 and defines the air chamber 160 together with the fixed electrode 140. The support 152 supports the fixed electrode 140.

As shown in FIG. 7, the acoustic resistor 170 covers the communication hole 150*h* from the rear side of the communication hole 150*h*. The acoustic resistor 170 is composed of a material, such as nonwoven fabric, sponge, or felt (for example, refer to Japanese Patent Publication No. 5484882). The acoustic resistor 170 functions as an acoustic resistor reducing the velocity of acoustic waves passing from the sound source through the acoustic resistor 170.

The metal mesh 180 has a shape of a disc in plan view. The metal mesh 180 is composed of metal. The metal mesh 180 is disposed between the unit case 110 and the diaphragm holder 130 and covers the acoustic-wave entering holes 110*h* from the rear side of the acoustic-wave entering holes 110*h*. The metal mesh 180 prevents intrusion of foreign objects from outside the unit case 110 into the unit case 110.

The metal mesh 180, the diaphragm holder 130 (diaphragm 120), the fixed electrode 140, the insulating base 150, and the acoustic resistor 170 are accommodated in the unit case 110, in this order from the opening of the unit case 110. The acoustic resistor 170 accommodated in the unit case 110 is disposed at the opening of the unit case 110 so as to cover the opening of the unit case 110 from the interior of the unit case 110.

The fixed electrode 140 is supported by the support 152 of the insulating base 150 inside the unit case 110. The sound holes 140*h* of the fixed electrode 140 face the depression 151 in the insulating base 150. The air chamber 160 is formed between the fixed electrode 140 and the depression 151.

The air chamber 160 adjusts the level of vibration of the diaphragm 120 in accordance with the volume of the air chamber 160. The air chamber 160 is in communication with the sound holes 140*h* in the fixed electrode 140 and the communication hole 150*h* in the insulating base 150.

The acoustic resistor 170 is fixed to the rear (back) face of the insulating base 150 by curling of the rear edge of the unit case 110. As a result of the curling, a curled portion 111 is formed in the rear edge of the unit case 110.

The operation of the unidirectional condenser microphone unit will now be described.

In the description below, among the acoustic waves from a sound source, the acoustic waves entering from the acoustic-wave entering holes 110*h* into the unit 101 and reach the front face of the diaphragm 120 are referred to as "front-face acoustic waves," and the acoustic waves entering from the communication hole 150*h* into the unit 101 and reach the back face of the diaphragm 120 are referred to as "back-face acoustic waves."

The operation of the unidirectional condenser microphone with a sound source disposed in front of the unidirectional condenser microphone (in front of the unit 101) will now be described.

The front-face acoustic waves reach the diaphragm 120 from the acoustic-wave entering holes 110*h* through the metal mesh 180. On the other hand, the back-face acoustic waves reach the diaphragm 120 through the acoustic resistor 170. As described above, the acoustic resistor 170 functions as an acoustic resistor. Thus, the velocity of the acoustic waves traveling through the acoustic resistor 170 is reduced by the acoustic resistor 170. The acoustic waves decelerated inside the acoustic resistor 170 reach the diaphragm 120 through the communication hole 150*h*, the air chamber 160, and the sound holes 140*h*.

The distances between the sound source and the respective acoustic-wave entering holes 110*h* are each smaller than the distance between the sound source and the acoustic resistor 170. Thus, the front-face acoustic waves reach the diaphragm 120 before the back-face acoustic waves. The back-face acoustic waves reach the diaphragm 120 after the front-face acoustic waves.

The diaphragm 120 is configured to vibrate in response to the acoustic waves reaching the diaphragm 120. The capacitance of the capacitor constituted by the diaphragm 120 and the fixed electrode 140 varies in response to the vibration of the diaphragm 120. The unit 101 generates an electrical signal corresponding to the variation in the capacitance. As described above the acoustic waves from the sound source in front of the unidirectional condenser microphone are collected by the unidirectional condenser microphone (unit 101).

The operation of the unidirectional condenser microphone with a sound source disposed behind the unidirectional condenser microphone (behind the unit 101) will now be described.

The front-face acoustic waves reach the diaphragm 120 from the acoustic-wave entering holes 110*h* through the metal mesh 180. On the other hand, the back-face acoustic waves reach the diaphragm 120 through the acoustic resistor 170. The velocity of the acoustic waves traveling through the acoustic resistor 170 is reduced. The acoustic waves decelerated inside the acoustic resistor 170 reach the diaphragm 120 through the communication hole 150*h*, the air chamber 160, and the sound holes 140*h*.

The distances between the sound source and the respective acoustic-wave entering holes 110*h* are each larger than the distance between the sound source and the acoustic resistor 170. The acoustic resistance of the acoustic resistor 170 is designed such that the timing of the front-face acoustic waves reaching the diaphragm 120 matches the timing of the back-face acoustic waves reaching the diaphragm 120. Thus, the timing of the front-face acoustic waves reaching the diaphragm 120 matches the timing of the back-face acoustic waves reaching the diaphragm 120.

The diaphragm 120 does not vibrate when the timing of the front-face acoustic waves reaching the front face of the diaphragm 120 matches the timing of the back-face acoustic waves reaching the back face of the diaphragm 120. That is, the unit 101 does not generate an electrical signal because the capacitance of the capacitor does not vary. In other words, the sound from the sound source behind the unidirectional condenser microphone is not collected by the unidirectional condenser microphone (unit 101).

As described above, the unit 101 collects sound from the sound source in front of the unit 101 but does not collect sound from the sound source behind the unit 101. That is, the directionality of the unit 101 is unidirectionality.

Since the acoustic resistor 170 is composed of a material, such as sponge, the acoustic resistance may vary due to the external environment, including humidity. For example, the acoustic resistor 170 absorbs moisture and expands in volume in a high humidity environment due to sweating of a user. The acoustic resistance of the acoustic resistor 170 increases due to the expansion in volume of the acoustic resistor 170. As a result, the degree of deceleration of the back-face acoustic waves passing the acoustic resistor 170 varies. Thus, the timing of the back-face acoustic waves from the sound source behind the unidirectional condenser microphone (behind the unit 101) reaching the diaphragm 120 does not match the timing of the front-face acoustic waves from the same sound source reaching the diaphragm 120. As a result, the diaphragm 120 vibrates. That is, the unit 101 collects sound from the sound source behind the unidirectional condenser microphone. In other words, the directionality of the unit 101 is affected by the variation in the acoustic resistance of the acoustic resistor 170.

An object of the present invention is to solve the problems described above and to provide a unidirectional condenser microphone unit and a unidirectional condenser microphone having directionality unaffected by the external environment, and a method of manufacturing the unidirectional condenser microphone.

Solution to Problem

A unidirectional condenser microphone unit according to the present invention having an interior and an exterior, the unidirectional condenser microphone includes a diaphragm, a fixed electrode facing the diaphragm, the fixed electrode constituting a capacitor with the diaphragm, an insulating base disposed in a back face side of the fixed electrode, the insulating base supporting the fixed electrode, an air chamber disposed in the back face side of the fixed electrode, and a gap disposed between the fixed electrode and the insulating base. The fixed electrode includes at least one sound hole in communication with the air chamber. The insulating base includes a communication hole establishing communication between the gap and the exterior of the microphone unit. The air chamber and the gap are in communication with each other.

According to the present invention, directionality is unaffected by the external environment.

DESCRIPTION OF EMBODIMENTS

Embodiments of a unidirectional condenser microphone unit, a unidirectional condenser microphone, and a method of manufacturing a unidirectional condenser microphone unit according to the present invention will now be described with reference to the attached drawings.

Configuration of Unidirectional Condenser Microphone

Figure 1:
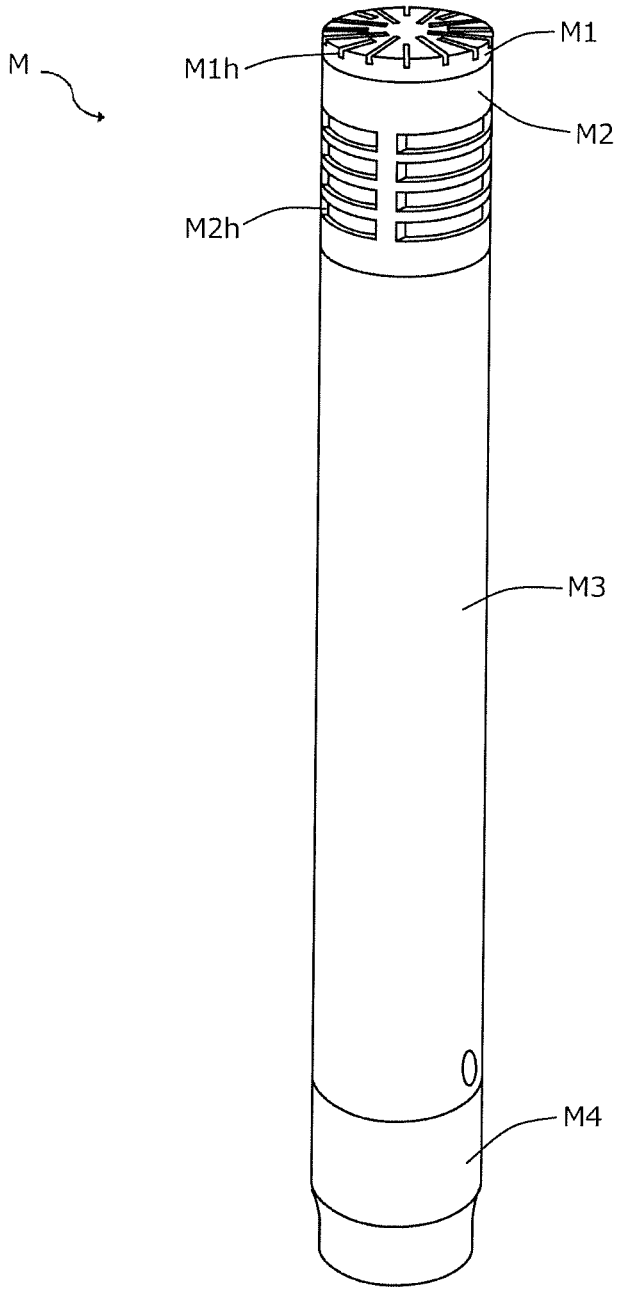
FIG. 1 is an external view illustrating an embodiment of a unidirectional condenser microphone according to the present invention.

FIG. 1 is an external view illustrating an embodiment of a unidirectional condenser microphone according to the present invention. A unidirectional condenser microphone (hereinafter referred to as "microphone") M includes a cap M1, a unit accommodating case M2, a circuit case M3, a rear case M4, and the unidirectional condenser microphone unit according to the present invention described below.

In the description below, the front of the microphone M is the direction of the microphone M directed to the sound source during sound collection (the upper side of FIG. 1). The rear of the microphone M is the direction opposite to the front of the microphone M (the lower side of FIG. 1).

The cap M1 is composed of metal and has a shape of a hollow cylinder with a bottom end. The cap M1 has sound holes M1*h* through which acoustic waves from the sound source pass. The sound holes M1*h* are disposed in the front end face as the bottom face of the cap M1. The cap M1 is attached to the front portion of the unit accommodating case M2 so as to cover the front opening of the unit accommodating case M2.

The unit accommodating case M2 is composed of metal and has a shape of a cylinder. The unit accommodating case M2 has sound holes M2*h* through which acoustic waves from the sound source pass. The sound holes M2*h* are disposed in the side face of the unit accommodating case M2. The unit accommodating case M2 accommodates the unidirectional condenser microphone unit according to the present invention described below.

The circuit case M3 is composed of metal and has a shape of a cylinder. The circuit case M3 is attached to the rear portion of the unit accommodating case M2. The circuit case M3 serves as a grip of the microphone M.

The rear case M4 is composed of metal and has a shape of a substantial hollow cylinder with a bottom end. The rear case M4 is attached to the rear portion of the circuit case M3. A connector plug (not shown) is disposed in the rear case M4.

Configuration of Unidirectional Condenser Microphone Unit

The configuration of the unidirectional condenser microphone unit according to the present invention will now be described.

Figure 2:
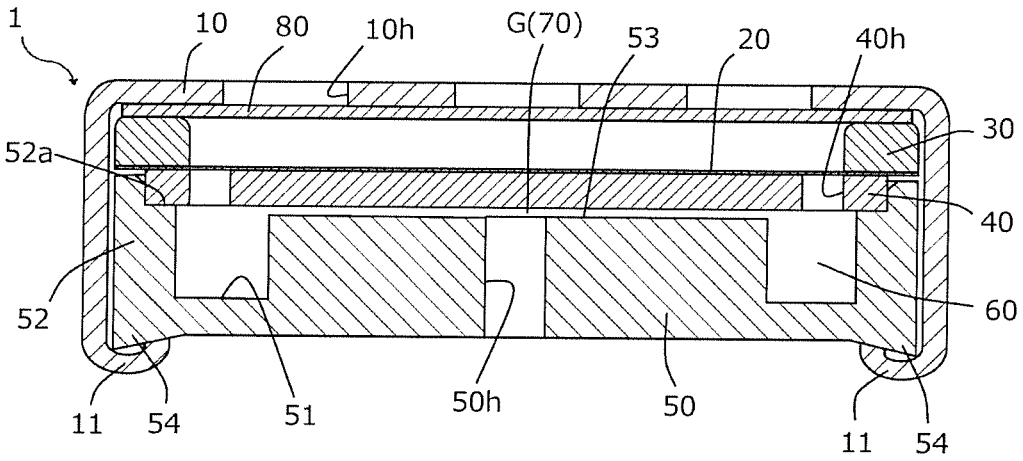
FIG. 2 is a cross-sectional front view of a unidirectional condenser microphone unit of the unidirectional condenser microphone in FIG. 1.

FIG. 2 is a cross-sectional front view of the unidirectional condenser microphone unit. The unidirectional condenser microphone unit (hereinafter referred to as "unit") 1 includes a unit case 10, a diaphragm 20, a diaphragm holder 30, a fixed electrode 40, an insulating base 50, an air chamber 60, a gap G, and a metal mesh 80.

The unit case 10 accommodates the diaphragm 20, the diaphragm holder 30, the fixed electrode 40, the insulating base 50, and the metal mesh 80. The unit case 10 has a shape of a hollow cylinder with a bottom end. The unit case 10 is a press-molded product composed of metal, such as aluminum. The unit case 10 has multiple acoustic-wave entering holes 10*h* and an opening. The acoustic-wave entering holes 10*h* introduce acoustic waves from the sound source into the unit 1. The multiple acoustic-wave entering holes 10*h* are disposed in the front end face as the bottom face (the face to be directed to the sound source during sound collection) of the unit case 10. The opening is disposed in the rear end portion of the unit case 10. The bottom face side (the upper side of FIG. 2) of the unit case 10 is referred to as the front of the unit 1, and the opening side (the lower side of FIG. 2) of the unit case 10 is referred to as the rear of the unit 1.

The diaphragm 20 vibrates in response to acoustic waves from the sound source. The diaphragm 20 is a thin circular film in plan view. The diaphragm 20 is composed of synthetic resin, for example. The diaphragm 20 is stretched on the diaphragm holder 30 at predetermined tension. The diaphragm holder 30 has a shape of a ring in plan view.

Figure 3:
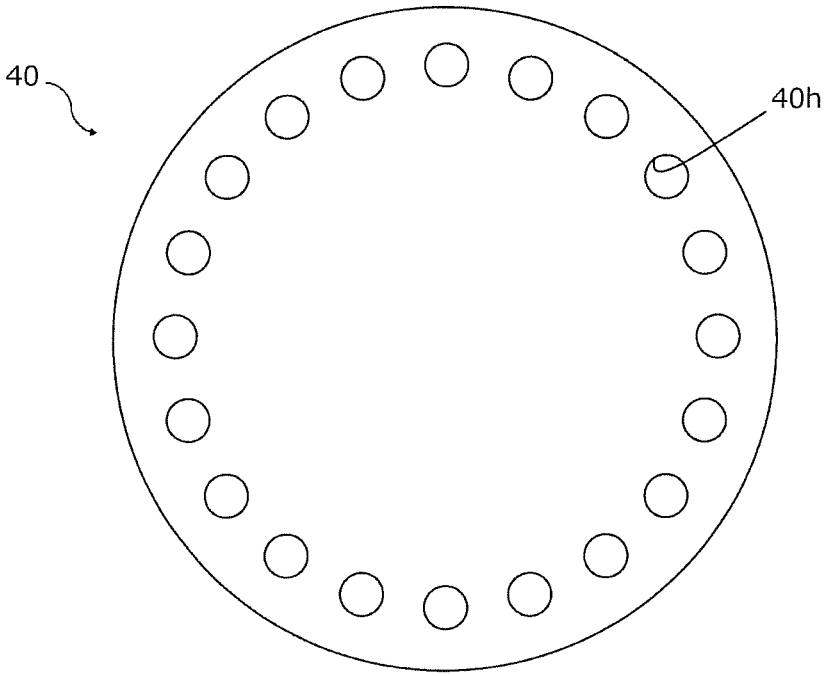
FIG. 3 is a plan view of a fixed electrode of the unidirectional condenser microphone unit in FIG. 2.

FIG. 3 is a plan view of the fixed electrode 40. The fixed electrode 40 has a shape of a disc in plan view. The fixed electrode 40 is composed of metal, for example. The fixed electrode 40 has multiple sound holes 40*h* in communication with the air chamber 60. The sound holes 40*h* are disposed adjacent to the outer circumference of the fixed electrode 40 at equal intervals along the circumferential direction of the fixed electrode 40.

The positions of the sound holes 40*h* in the fixed electrode 40 should be determined such that the sound holes 40*h* are in communication with to the air chamber 60. For example, the sound holes 40*h* may be disposed in the fixed electrode 40 anywhere other than along the circumferential direction of the fixed electrode 40.

As shown in FIG. 2, the fixed electrode 40 faces the diaphragm 20 with a spacer (not shown) disposed therebetween and constitutes a capacitor with the diaphragm 20. An air layer having a thickness equivalent to the thickness of the spacer is formed between the diaphragm 20 and the fixed electrode 40.

Figure 4:
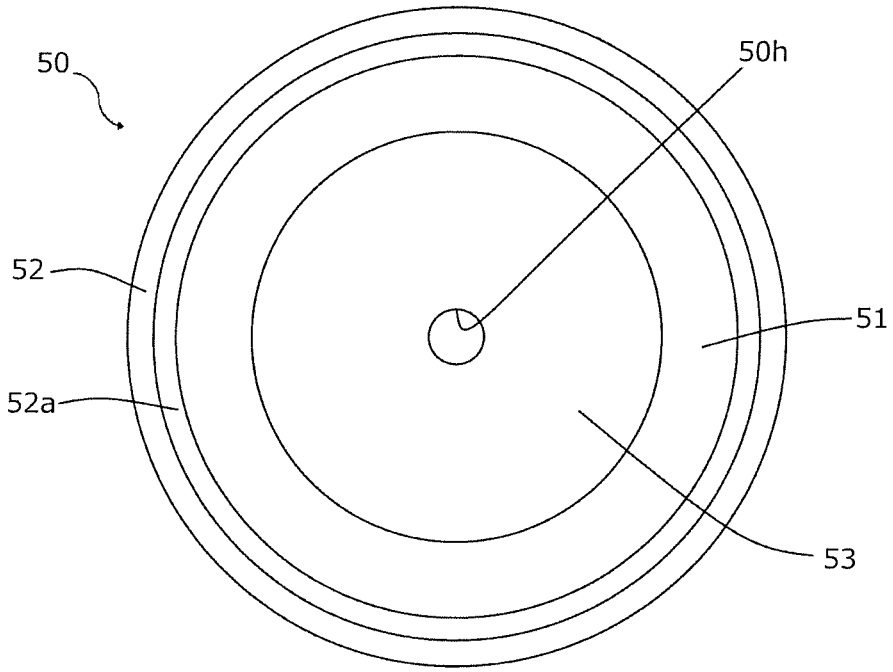
FIG. 4 is a plan view of an insulating base of the unidirectional condenser microphone unit in FIG. 2.

FIG. 4 is a plan view of the insulating base 50. The insulating base 50 supports the fixed electrode 40. The insulating base 50 is composed of synthetic resin, for example. The insulating base 50 has a shape of a disc in plan view. The insulating base 50 has a communication hole 50*h*, a groove 51, a support 52, a central surface 53, and a protrusion 54. The communication hole 50*h* is disposed in the center of the insulating base 50 across the thickness of the insulating base 50. The groove 51 has a shape of a ring along the circumferential direction of the insulating base 50. The groove 51 is disposed in the outer circumferential portion of the front face of the insulating base 50. The support 52 has a shape of a substantial cylinder. The support 52 is disposed outward of the groove 51 on the front face of the insulating base 50 in the radial direction of the insulating base 50. The support 52 has a step 52*a*. The step 52*a* is a rearward stepped portion in the thickness direction of the insulating base 50 and is disposed in the inner circumference of the front face of the support 52. The central surface 53 is the front face of the insulating base 50, not including the communication hole 50*h*, the groove 51, and the support 52. As described above, the insulating base 50 includes the communication hole 50*h*, the central surface 53, the groove 51, the step 52*a*, and the support 52 in this order from the center along the radial direction in plan view.

As shown in FIG. 2, the protrusion 54 is disposed in the outer circumference of the rear (back) face of the insulating base 50. The protrusion 54 has a shape of a ring along the circumferential direction of the insulating base 50 in plan view. The protrusion 54 protrudes toward the rear gradually from the inner circumference to the outer circumference of the ring area. The rear (back) face of the protrusion 54 is sloped over the entire circumference.

The protrusion 54 may be disposed on only a part of the back face of the insulating base 50.

As shown in FIG. 2, the central surface 53 of the insulating base 50 is disposed further to the rear than the front face of the step 52*a* in the thickness direction of the insulating base 50 (the vertical direction in FIG. 2).

Figure 5:
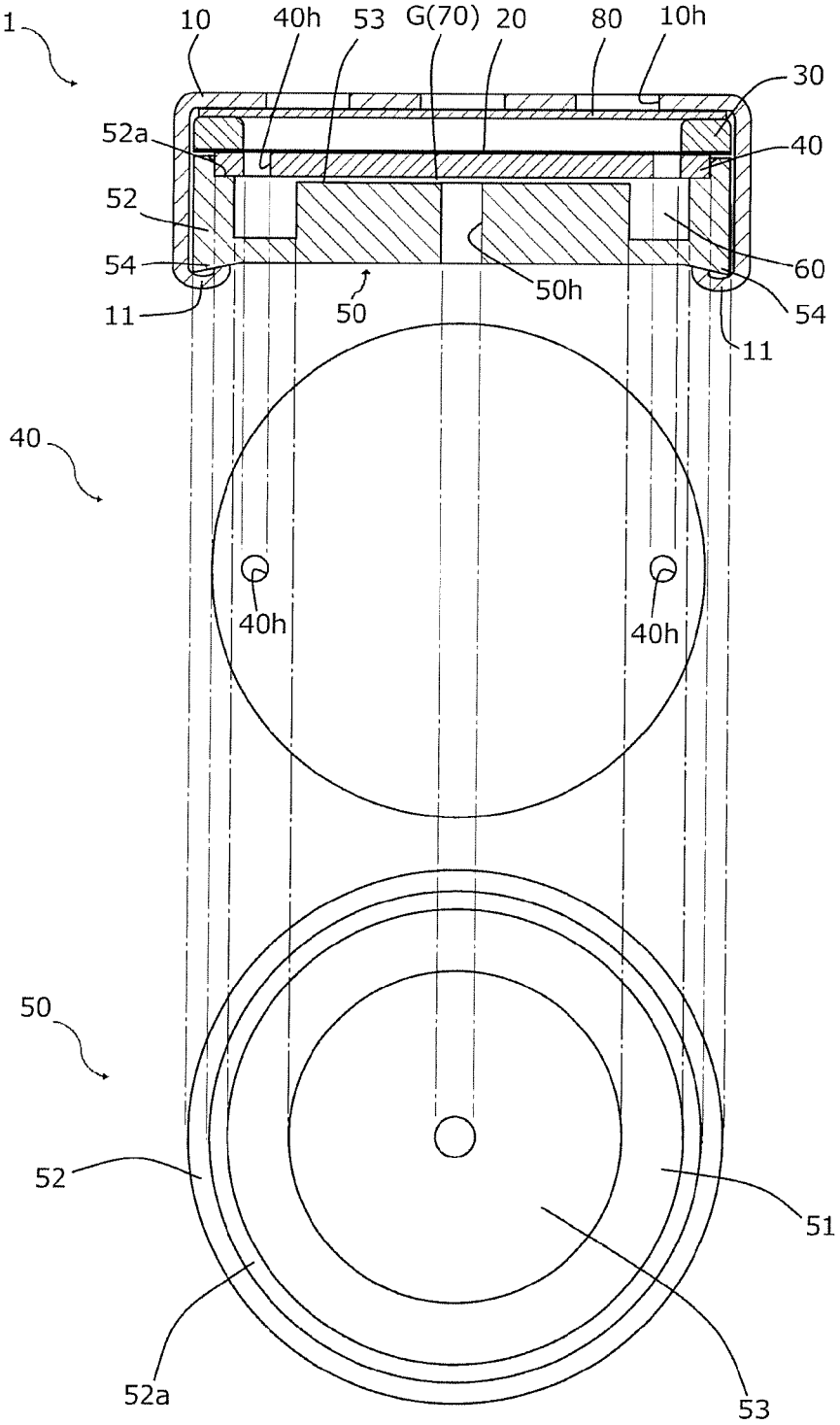
FIG. 5 is a schematic view illustrating the positional relationship between the fixed electrode and the insulating base of the unidirectional condenser microphone unit in FIG. 2.

FIG. 5 is a schematic view illustrating the positional relationship between the fixed electrode 40 and the insulating base 50. In FIG. 5, only two of the sound holes 40*h* of the fixed electrode 40 are illustrated and the other sound holes 40*h* are not illustrated. The diaphragm holder 30 (diaphragm 20), the fixed electrode 40, and the insulating base 50 are accommodated in the unit case 10 through the opening of the unit case 10 in this order. The insulating base 50 accommodated in the unit case 10 is disposed at the opening of the unit case 10 so as to cover the opening of the unit case 10 from the interior of the unit case 10.

The fixed electrode 40 inside the unit case 10 is fit with the step 52*a* in the support 52 and supported by the support 52. That is, the insulating base 50 is disposed in the rear (back) face side of the fixed electrode 40 and supports the fixed electrode 40. The sound holes 40*h* in the fixed electrode 40 face the groove 51 of the insulating base 50. The air chamber 60, which is defined by the fixed electrode 40 and the groove 51 of the insulating base 50, is formed between the fixed electrode 40 and the insulating base 50. That is, the air chamber 60 is disposed in the back face side of the fixed electrode 40. The air chamber 60 will be described below.

The central surface 53 of the insulating base 50 faces the back face of the fixed electrode 40. As described above, the central surface 53 is disposed further to the rear than the front face of the step 52*a* in the thickness direction of the insulating base 50. Thus, the gap G is disposed between the insulating base 50 and the fixed electrode 40. The gap G accommodates an air layer. The gap G serves or functions as an air chamber for the air layer. As described below, the volume of the gap G is designed to be smaller than the volume of the air chamber 60. As a result, the air layer accommodated in the gap G between the central surface 53 of the insulating base 50 and the back face of the fixed electrode 40 is a thin air layer 70. The communication hole 50*h* establishes communication between the gap G and the exterior of the unit 1. The thin air layer 70 will be described below.

In the path inside the unit case 10 through which acoustic waves travel from the communication hole 50*h* to the diaphragm 20, the side of the communication hole 50*h* is referred to as "the upstream" side and the side of the diaphragm 20 is referred to as "the downstream" side.

The acoustic waves entering the unit case 10 from the communication hole 50*h* reach the air chamber 60 through the thin air layer 70 in the gap G and then pass through the sound holes 40*h*. That is, the air chamber 60 is disposed downstream of the gap G. The gap G is disposed upstream of the air chamber 60.

As shown in FIG. 2, the insulating base 50 is fixed inside the unit case 10 by curling of the open end (rear end) of the unit case 10. As a result of the curling, a curled portion 11 is formed in the rear edge of the unit case 10. The end of the curled portion 11 is engaged with the protrusion 54 of the insulating base 50 such that the protrusion 54 of the insulating base 50 is held between the end of the curled portion 11 and the sidewall of the unit case 10. As described above, the protrusion 54 has a sloped back face. Thus, the insulating base 50 is biased toward the front end of the unit case 10 by the end of the curled portion 11. As a result, the metal mesh 80, the diaphragm holder 30 (diaphragm 20), and the fixed electrode 40 accommodated in the unit case 10 are fixed inside the unit case 10 and are biased toward the front end of the unit case 10 by the insulating base 50.

The air chamber 60 adjusts the level of vibration of the diaphragm 20. As the air chamber 60 increases to a larger volume, the diaphragm 20 is more susceptible to vibration. As the air chamber 60 decreases to a smaller volume, the diaphragm 20 is less susceptible to vibration. The air chamber 60 is formed on the outer circumference of the gap G. That is, the air chamber 60 is formed downstream of the gap G. The volume of the air chamber 60 is larger than the volume of the gap G. The air chamber 60 is a space in communication with the gap G and the sound holes 40*h*. The air chamber 60 surrounds the outer circumference of the gap G. That is, the gap G is disposed inward in the radial direction of the insulating base 50 from the air chamber 60 in plan view of the unit 1.

The thin air layer 70 is an air layer functioning as an acoustic resistor of the unit 1. The thin air layer 70 adjusts the velocity of the acoustic waves traveling from the sound source through the thin air layer 70 and transmits the acoustic waves to the air chamber 60. The gap G accommodating the thin air layer 70 is in communication with the communication hole 50*h* and the air chamber 60.

The space inside the gap G is a space having a volume smaller than the volume of the air chamber 60. In the path of acoustic waves to the diaphragm 20, the gap G is disposed upstream of the air chamber 60, which is in communication with the gap G. Since the thin air layer 70 is an air layer, the acoustic resistance of the thin air layer 70 does not vary due to a variation in the external environment, such as humidity.

The metal mesh 80 has a shape of a disc in plan view. The metal mesh 80 is composed of metal. The metal mesh 80 is disposed between the bottom face of the unit case 10 and the diaphragm holder 30 and covers the acoustic-wave entering holes 10*h* from the rear side of the acoustic-wave entering holes 10*h*. The metal mesh 80 prevents intrusion of foreign objects from outside the unit case 10 into the unit case 10.

Figure 6:
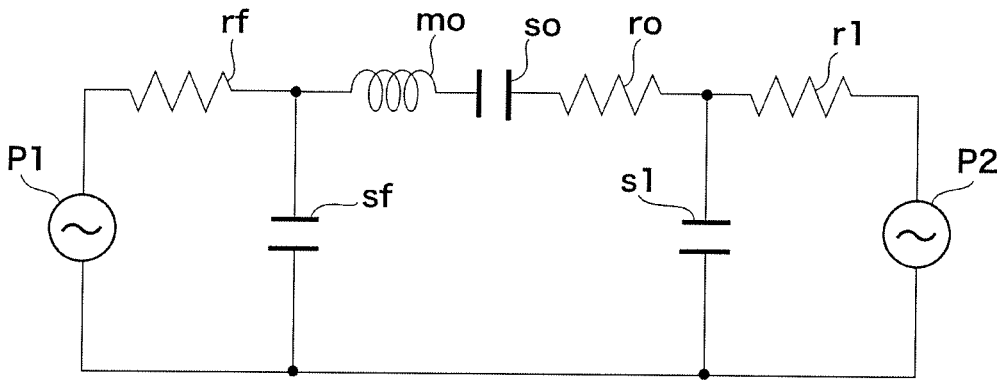
FIG. 6 is an equivalent circuit diagram of the unidirectional condenser microphone unit in FIG. 2.
Figure 7:
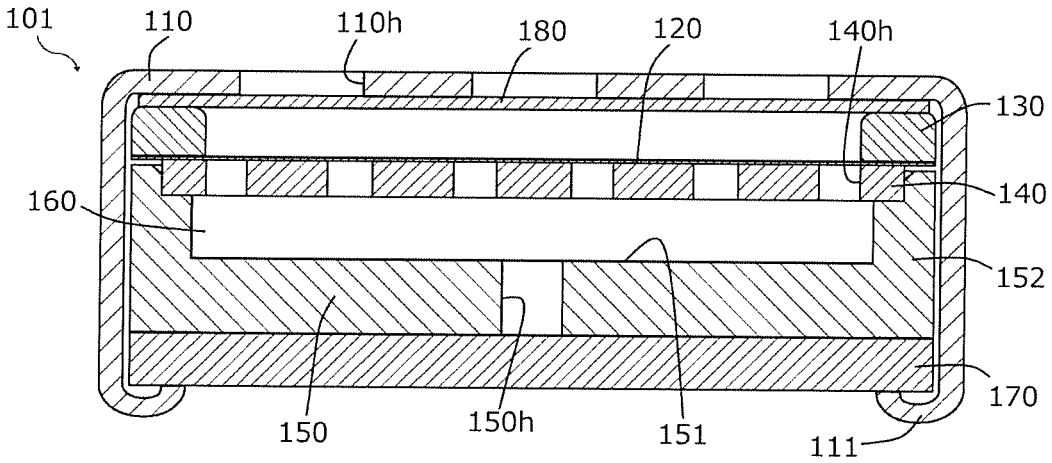
RELATED ART FIG. 7
FIG. 7 is a cross-sectional front view of a conventional unidirectional condenser microphone unit.
Figure 8:
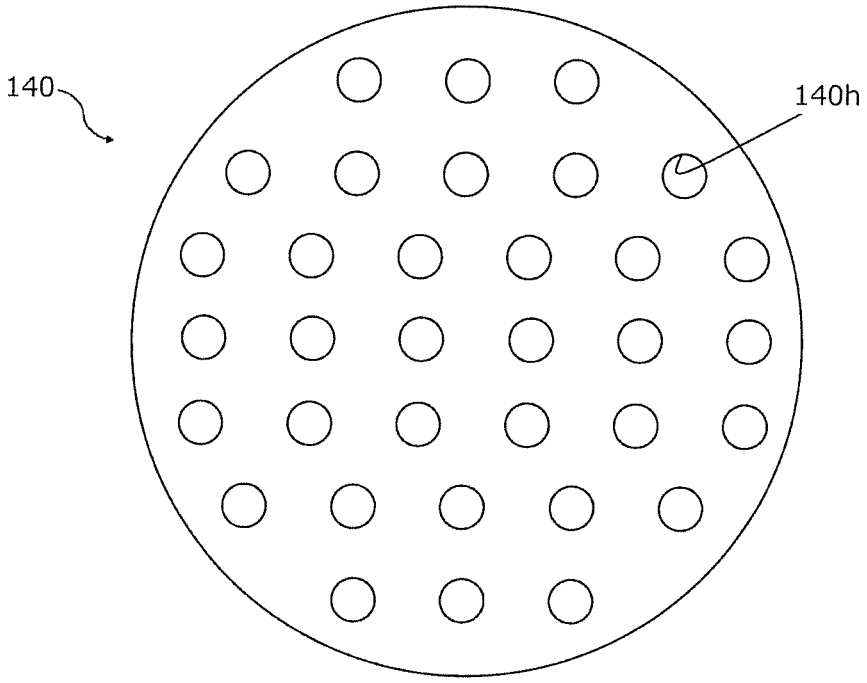
RELATED ART FIG. 8
FIG. 8 is a plan view of a fixed electrode of a conventional unidirectional condenser microphone unit.
Figure 9:
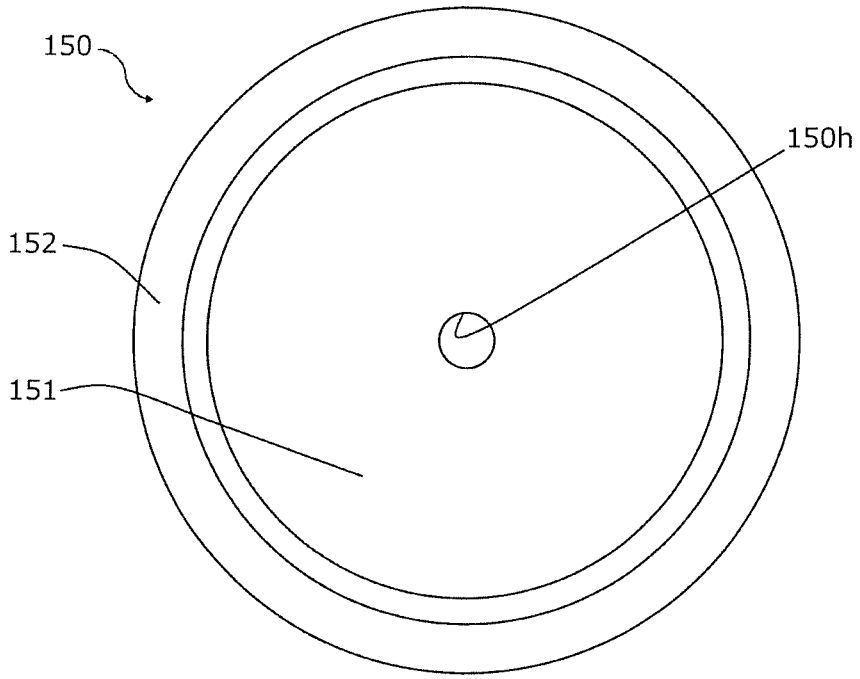
RELATED ART FIG. 9
FIG. 9 is a plan view of an insulating base of a conventional unidirectional condenser microphone unit.

FIG. 6 is an equivalent circuit diagram of the unit 1. In FIG. 6, sign P1 represents the sound source as a front acoustic terminal; sign P2 represents the sound source as a rear acoustic terminal; sign rf represents an acoustic resistor of the metal mesh 80; sign sf represents the stiffness of the air in the air chamber residing between the metal mesh 80 and the diaphragm 20; sign mo represents the mass of the diaphragm 20; sign so represents the stiffness of the diaphragm 20; sign ro represents the damping resistance of the diaphragm 20 by the air layer residing between the diaphragm 20 and the fixed electrode 40; sign s1 represents the stiffness of the air in the air chamber 60; and sign r1 represents the acoustic resistance of the thin air layer 70.

The acoustic terminal refers to the position of the air applying effectively acoustic pressure to the unit 1. In other words, the acoustic terminal is the central position in the air flowing in response to the movement of the diaphragm 20. Since the unit 1 has unidirectionality, the acoustic terminals reside at the front and rear of the diaphragm 20.

Method of Manufacturing Unidirectional Condenser Microphone Unit

A method of manufacturing the unit 1 will now be described.

The method of manufacturing the unit 1 includes an accommodating process and a curling process.

The accommodating process will now be described.

In the accommodating process, the metal mesh 80, the diaphragm holder 30 (diaphragm 20), the fixed electrode 40, and the insulating base 50 are accommodated in this order in the unit case 10. As described above, the insulating base 50 accommodated in the unit case 10 is disposed in the opening of the unit case 10 so as to cover the opening of the unit case 10 from the interior of the unit case 10.

The curling process will now be described.

In the curling process, the open end (rear end) of the unit case 10 is curled. As a result of the curling, the metal mesh 80, the diaphragm holder 30 (diaphragm 20), and the fixed electrode 40, which are accommodated in the unit case 10, are fixed inside the unit case 10 with the insulating base 50, as described above.

In the curling process, the air chamber 60 is formed in the back face side of the fixed electrode 40, and the gap G is formed between the fixed electrode 40 and the insulating base 50. As described above, the gap G is in communication with the air chamber 60.

As described above, the air chamber 60 formed in the curling process is in communication with sound holes 40*h*. The gap G formed in the curling process is in communication with the communication hole 50*h*. That is, the sound holes 40*h* are in communication with the communication hole 50*h* after the curling process.

Operation of Unidirectional Condenser Microphone Unit

The operation of the unit 1 will now be described.

In the description below, among the acoustic waves from the sound source, the acoustic waves entering from the acoustic-wave entering holes 10*h* into the unit 1 and reaching the front face of the diaphragm 20 are referred to as "front-face acoustic waves," and the acoustic waves entering from the communication hole 50*h* into the unit 1 and reaching the back face of the diaphragm 20 are referred to as "back-face acoustic waves."

The operation of the microphone M when the sound source is disposed in front of the microphone M will now be described.

Since the sound source is disposed in front of the microphone M, the distances between the sound source and the respective acoustic-wave entering holes 10*h* are each smaller than the distance between the sound source and the communication hole 50*h*. As a result, the time required for acoustic waves from the sound source to reach the acoustic-wave entering holes 10*h* (hereinafter referred to as "first arrival time") is shorter than the time required for acoustic waves from the sound source to reach the communication hole 50*h* (hereinafter referred to as "second arrival time").

The front-face acoustic waves enter the unit 1 through the acoustic-wave entering holes 10*h* and reach the diaphragm 20 through the metal mesh 80. On the other hand, the back-face acoustic waves enter the unit 1 through the communication hole 50*h* and travel through the thin air layer 70. As described above, the thin air layer 70 functions as an acoustic resistor. Thus, the velocity of the acoustic waves traveling through the thin air layer 70 is reduced by the thin air layer 70. The acoustic waves decelerated inside the thin air layer 70 reach the diaphragm 20 through the air chamber 60 and the sound holes 40*h*.

As described above, the first arrival time is shorter than the second arrival time. That is, the front-face acoustic waves travel through the unit 1 before the back-face acoustic waves. The velocity of the front-face acoustic waves not passing through the thin air layer 70 is larger than the velocity of the back-face acoustic waves passing through the thin air layer 70. Thus, the timing of the front-face acoustic waves reaching the diaphragm 20 is earlier than the timing of the back-face acoustic waves reaching the diaphragm 20.

When the timing of the front-face acoustic waves reaching the front face of the diaphragm 20 differs from the timing of the back-face acoustic waves reaching the back face of the diaphragm 20, the diaphragm 20 vibrates in response to both the front-face acoustic waves and the back-face acoustic waves. The capacitance of the capacitor constituted by the diaphragm 20 and the fixed electrode 40 varies in response to the vibration of the diaphragm 20. The unit 1 generates an electrical signal corresponding to the variation in the capacitance. As described above, the acoustic waves from the sound source in front of the microphone M are collected by the microphone M (unit 1).

The operation of the microphone M when the sound source is disposed behind the microphone M will now be described.

Since the sound source is disposed behind the microphone M, the distances between the sound source and the respective acoustic-wave entering holes 10*h* are each larger than the distance between the sound source and the communication hole 50*h*. As a result, the first arrival time is longer than the second arrival time.

The front-face acoustic waves enter the unit 1 from the acoustic-wave entering holes 10*h* and reach the diaphragm 20 through the metal mesh 80. On the other hand, the back-face acoustic waves enter the unit 1 from the communication hole 50*h* and travel through the thin air layer 70. As described above, the thin air layer 70 functions as an acoustic resistor. Thus, the velocity of the acoustic waves traveling through the thin air layer 70 is reduced by the thin air layer 70. The acoustic waves decelerated inside the thin air layer 70 reach the diaphragm 20 through the air chamber 60 and the sound holes 40*h*.

As described above, the first arrival time is longer than the second arrival time. That is, the back-face acoustic waves travel through the unit 1 before the front-face acoustic waves. The velocity of the back-face acoustic waves passing through the thin air layer 70 is smaller than the velocity of the front-face acoustic waves not passing through the thin air layer 70.

The acoustic resistance of the thin air layer 70 varies in accordance with the ratio of the volume of the gap G to the volume of the air chamber 60, the communication hole 50*h*, or the sound holes 40*h*, for example. The acoustic resistance of the thin air layer 70 is designed such that, when the sound source is disposed behind the microphone M, the timing of the front-face acoustic waves reaching at the diaphragm 20 matches the timing of the back-face acoustic waves reaching the diaphragm 20. Thus, the timing of the front-face acoustic waves reaching the diaphragm 20 matches the timing of the back-face acoustic waves reaching the diaphragm 20.

The diaphragm 20 does not vibrate when the timing of the front-face acoustic waves reaching the front face of the diaphragm 20 matches the timing of the back-face acoustic waves reaching the back face of the diaphragm 20. That is, the capacitance of the capacitor does not vary. Thus, the unit 1 does not generate an electrical signal. In other words, the acoustic waves from the sound source disposed behind the microphone M is not collected by the microphone M (unit 1).

As described above, the unit 1 collects sound from the sound source in front of the unit 1 but does not collect sound from the sound source behind the unit 1. That is, the directionality of the unit 1 is unidirectionality.

As described above, the unidirectionality of the unit 1 is achieved by reducing the velocity of the back-face acoustic waves by the thin air layer 70. The thin air layer 70 functions as an acoustic resistor of the unit 1. Since the thin air layer 70 is an air layer, the acoustic resistance of the thin air layer 70 is independent from the external environment, and does not vary due to the external environment, such as humidity. Thus, the directionality of the unit 1 is unaffected by the external environment.

The gap G is defined by the central surface 53 of the insulating base 50 and the back face of the fixed electrode 40. Alternatively, the gap G may be defined by only the insulating base 50. For example, a hole as a gap establishing communication between the air chamber 60 and the communication hole 50*h* may be disposed in the insulating base 50.

CONCLUSION

According to the embodiments described above, the gap G accommodating the thin air layer 70 functioning as an acoustic resistor is formed between the fixed electrode 40 and the insulating base 50 in the unit 1. The thin air layer 70 reduces the velocity of the back-face acoustic waves such that, when the sound source is behind the microphone M, the timing of the front-face acoustic waves reaching the front face of the diaphragm 20 matches the timing of the back-face acoustic waves reaching the back face of the diaphragm 20. As a result, the unit 1 operates with unidirectionality. Since the thin air layer 70 is an air layer, the acoustic resistance of the thin air layer 70 is unaffected by the external environment, such as humidity. In other words, the directionality of the unit 1 is unaffected by the external environment.

The microphone M includes the unit 1. As described above, the directionality of the unit 1 is unaffected by the external environment. Thus, the directionality of the microphone M is also unaffected by the external environment.

The end of the curled portion 11 is engaged with the protrusion 54 of the insulating base 50 such that the protrusion 54 of the insulating base 50 is held between the end of the curled portion 11 and the sidewall of the unit case 10. The insulating base 50 is biased toward the front end of the unit case 10 by the end of the curled portion 11. As a result, the diaphragm holder 30 (diaphragm 20) and the fixed electrode 40 accommodated in the unit case 10 are fixed inside the unit case 10 and are biased toward the front end of the unit case 10 by the insulating base 50. Thus, the diaphragm holder 30 (diaphragm 20), the fixed electrode 40, and the insulating base 50 accommodated inside the unit case 10 are stably fixed inside the unit case 10, compared to those in a conventional microphone unit without a protrusion. That is, the fixed electrode 40 and the insulating base 50 are stably fixed. In other words, the volume of the gap G does not vary, and the acoustic resistance of the thin air layer 70 does not vary.

The invention claimed is:

1. A unidirectional condenser microphone unit having an interior and an exterior, the unidirectional condenser microphone comprising:

a diaphragm;

a fixed electrode facing the diaphragm, the fixed electrode constituting a capacitor with the diaphragm;

an insulating base disposed in a back face side of the fixed electrode, the insulating base supporting the fixed electrode;

an air chamber disposed between the fixed electrode and the insulating base; and a gap disposed between the fixed electrode and a central surface of the insulating base, the gap is disposed inward from the air chamber and above the central surface of the insulating base, and the air chamber is outside the central surface of the insulating base, wherein the fixed electrode comprises at least one sound hole in communication with the air chamber, the insulating base comprises a communication hole establishing communication between the gap and the exterior of the microphone unit, and the air chamber and the gap are in communication with each other.

2. The unidirectional condenser microphone unit according to claim 1, wherein the gap accommodates an air layer, and the air layer functions to transmit the acoustic waves from the communication hole as an acoustic resistor to the air chamber.

3. The unidirectional condenser microphone unit according to claim 1, wherein the fixed electrode has a shape of a plate, and the at least one sound hole comprises a plurality of sound holes disposed along a circumferential direction of the fixed electrode.

4. The unidirectional condenser microphone unit according to claim 3, wherein the air chamber constituted by a groove disposed in the insulating base along a circumferential direction of the insulating base.

5. The unidirectional condenser microphone unit according to claim 4, wherein the insulating base comprises a support, the support comprises a step, and the fixed electrode is fit with the step in the support and supported by the support.

6. The unidirectional condenser microphone unit according to claim 4, wherein the air chamber surrounds an outer circumference of the gap.

7. The unidirectional condenser microphone according to claim 1, wherein the gap has a smaller volume than the air chamber.

8. The unidirectional condenser microphone unit according to claim 1, further comprising:

a unit case having a shape of a cylinder with an open end and a bottom end, the unit case accommodating the diaphragm, the fixed electrode, and the insulating base, wherein the unit case has an opening covered by the insulating base, the open end of the unit case has a curled portion, the insulating base has a protrusion engaging with the curled portion, and the protrusion is disposed on an outer circumference of a back face of the insulating base.

9. A unidirectional condenser microphone comprising:

a condenser microphone unit; and a unit accommodating case accommodating the condenser microphone unit, wherein the condenser microphone unit is the unidirectional condenser microphone unit according to claim 1.

10. A method of manufacturing a unidirectional condenser microphone unit having an interior and an exterior comprising: a diaphragm;

a fixed electrode facing the diaphragm, the fixed electrode constituting a capacitor with the diaphragm;

an insulating base disposed in a back face side of the fixed electrode, the insulating base supporting the fixed electrode; and a unit case having a shape of a cylinder with an open end and a bottom end, the unit case accommodating the diaphragm, the fixed electrode, and the insulating base, the method comprising the steps of:

a) accommodating the diaphragm, the fixed electrode, and the insulating base in the unit case; and b) curling the open end of the unit case, wherein step b) comprises:

forming an air chamber between the fixed electrode and the insulating base;

forming a gap between the fixed electrode and a central surface of the insulating base, the gap is disposed inward from the air chamber and above the central surface of the insulating base, and the air chamber is disposed outside the central surface of the insulating base;

establishing communication between the air chamber and the gap; and wherein the fixed electrode has a sound hole in communication with the air chamber, the insulating base has a communication hole establishing communication between the gap and the exterior of the microphone unit, and the sound hole is in communication with the communication hole after the step b).

11. A unidirectional condenser microphone unit having an interior and an exterior, the unidirectional condenser microphone comprising:

a diaphragm;

a fixed electrode facing the diaphragm, the fixed electrode constituting a capacitor with the diaphragm;

an insulating base disposed in a back face side of the fixed electrode, the insulating base supporting the fixed electrode;

an air chamber disposed between the fixed electrode and the insulating base; and a gap disposed between the fixed electrode and the insulating base, the gap is disposed inward from the air chamber and has a smaller volume than the air chamber, wherein the fixed electrode comprises at least one sound hole in communication with the air chamber, the insulating base comprises a communication hole establishing communication between the gap and the exterior of the microphone unit, and the air chamber and the gap are in communication with each other.

12. The unidirectional condenser microphone unit according to claim 11, wherein the gap accommodates an air layer, and the air layer functions to transmit the acoustic waves from the communication hole as an acoustic resistor to the air chamber.

13. The unidirectional condenser microphone unit according to claim 11, wherein the fixed electrode has a shape of a plate, and the at least one sound hole comprises a plurality of sound holes disposed along a circumferential direction of the fixed electrode.

14. The unidirectional condenser microphone unit according to claim 13, wherein the air chamber constituted by a groove disposed in the insulating base along a circumferential direction of the insulating base.

15. The unidirectional condenser microphone unit according to claim 14, wherein the insulating base comprises a support, the support comprises a step, and the fixed electrode is fit with the step in the support and supported by the support.

16. The unidirectional condenser microphone unit according to claim 14, wherein the air chamber surrounds an outer circumference of the gap.

17. The unidirectional condenser microphone unit according to claim 11, further comprising:

a unit case having a shape of a cylinder with an open end and a bottom end, the unit case accommodating the diaphragm, the fixed electrode, and the insulating base, wherein the unit case has an opening covered by the insulating base, the open end of the unit case has a curled portion, the insulating base has a protrusion engaging with the curled portion, and the protrusion is disposed on an outer circumference of a back face of the insulating base.

18. A unidirectional condenser microphone comprising:

a condenser microphone unit; and a unit accommodating case accommodating the condenser microphone unit, wherein the condenser microphone unit is the unidirectional condenser microphone unit according to claim 11.

* * * * *